United States Patent [19]

Tuchenhagen

[11] 4,343,656

[45] Aug. 10, 1982

[54] PROCESS FOR MONITORING TANK INSIDE CLEANERS DRIVEN BY CLEANSERS

[76] Inventor: Otto A. P. Tuchenhagen, Berliner Strasse 10, D-2059 Büchen, Fed. Rep. of Germany

[21] Appl. No.: 142,993

[22] Filed: Apr. 23, 1980

[30] Foreign Application Priority Data

Apr. 24, 1979 [DE] Fed. Rep. of Germany ..... 2916468

[51] Int. Cl.[3] ..... B08B 9/04

[52] U.S. Cl. ..... 134/18; 134/24; 134/113

[58] Field of Search ..... 134/24, 18, 113, 56 R, 134/57 R, 167 R; 340/671

[56] References Cited

U.S. PATENT DOCUMENTS

| | | | |
|---|---|---|---|
| 2,245,554 | 6/1941 | Court | 134/24 |
| 2,714,080 | 7/1955 | Kennedy, Jr. et al. | 134/24 |
| 2,991,203 | 7/1961 | In'T Veld | 134/24 |
| 3,121,027 | 2/1964 | Galanor | 134/24 |
| 3,150,669 | 9/1964 | Green, Jr. | 134/113 |
| 3,500,375 | 3/1970 | Klimo | 340/671 |
| 3,739,367 | 6/1973 | Fathauer | 340/671 |
| 3,792,460 | 2/1974 | Ratz | 340/671 |

*Primary Examiner*—S. Leon Bashore, Jr.
*Assistant Examiner*—Michael Goldman
*Attorney, Agent, or Firm*—Jenkins, Coffey, Hyland, Badger & Conard

[57] ABSTRACT

A process for cleaning tank interiors uses a rotary element and a cleanser discharge nozzle and monitors the completion of each full revolution of the rotary element. The cleanser quantity made available per unit of time is monitored and/or controlled or regulated. In the process, the time of each revolution of the rotary element is monitored in such a fashion that said time is represented by the spacing in time of two voltage pulses, with the last voltage pulse serving as a reset pulse for the monitoring time. The monitoring time represents the requirement of a sufficient cleaning effect and exceeds by an adjustable percentage the set time of revolution for a rotary element. In the event each rotary element revolution is completed within the monitoring time, the monitoring begins anew. In the event that the time of revolution of the rotary element exceeds the monitoring time, an electrical, optical, or acoustical malfunction or control signal is given.

7 Claims, 5 Drawing Figures

T=1/f
I
II
t
u
S
$t_A$
$t_Ü$
20f
20d
20g
20e
B
A
20a
20b
20c
20
Z
$i_e$
$i_a$
18
19
10
11
12
13
16
17
8
9
3
2
7
1
m

PROCESS FOR MONITORING TANK INSIDE CLEANERS DRIVEN BY CLEANSERS

The invention concerns a process and a device for monitoring tank interior cleaners driven by cleansers. Such cleaners feature a revolving body forming part of the cleanser feed path to at least one discharge nozzle and indicate the completion of each full revolution of the rotary body.

The invention relates to the cleaning of liquid containers. Such containers are used in the foodstuff industry for storing or preparing a liquid. Following the liquid withdrawal, cleaning operations are necessary in order to have available, prior to the introduction of fresh liquids, a hygienically satisfactory interior. The invention is geared especially to fermenting tanks for the production of beer. Such tanks have sufficiently large dimensions that several tank interior cleaners, suitably spaced one from the other, can be provided on such a container.

On a prior tank interior cleaner, such as disclosed in German patent disclosure No. 26 45 401, a turbine wheel, driven by the discharge cleanser and through a transmission, drives the rotary element on which a nozzle is located. The frequency of rotation of the nozzle-equipped rotary element is an actual function of the cleanser flow to the tank interior cleaner during cleaning operation. The frequency of rotation is governed only by the turbine wheel and transmission design; that is, by an equipment constant which is determined by the equipment design. At constant mass flow, the number of revolutions of the rotary element completed within a given time span is a clear measure of the quantity of cleanser that is passed during this time span; and the tank interior cleaner can only then be shut off in accordance with a revolution counter after it has completed a certain number of revolutions that have been determined as necessary for success of the cleaning operation. Due to the direct coupling between the quantity of cleanser used and the number of revolutions of the rotary body, it is thus possible to determine the cleanser quantity which is deemed necessary for the desired success of cleaning by means of the rotary element revolution; and in this specific case, a control of the desired optimum cleaning effect can be effected through the determination of cleanser quantity.

However, with the prior device, variations from the operation determined for optimum cleaning effect could not be detected or indicated since the time period for the revolutions of the rotary body were not registered. For instance, a reduced flow of cleaner means less kinetic energy of the cleanser jet and a reduced gush effect, or impact, on the tank's surface. Although the throughput of the apparent required cleanser quantity was indicated by the revolution counter, the optimum cleaning effect was not achieved because the amount represents only one necessary, but not sufficient, condition for the optimum cleaning effect.

The purpose of the present invention is to monitor the cleansing circulation power which is necessary for the contemplated cleaning effect through further providing and processing a signal from a tank interior cleaner of the type set forth above to indicate both the completion of rotary body revolution and the cleaning effect of the tank interior cleaner.

The following cases of malfunction are signaled by the method according to the invention:

1. The tank inside cleaner malfunctions mechanically, for instance, the rotary element rotates too slowly or is blocked. Such malfunctions are indicated electrically and optically by providing a signal including a reset pulse and monitoring time such that a reset pulse does not appear within the required monitoring time.

2. The solvent line is choked. Reduced cleanser throughput immediately results in a corresponding reduction of the frequency of rotation of the rotary body of the tank interior cleaner which is sensed by the lapse of the monitoring time without the occurrence of a reset pulse as set forth above.

3. The cleaner pump is not producing the necessary flow. The effect of a malfunction of the cleanser pump is set forth in the same manner as set forth in paragraph 2 above.

To avoid unjustified malfunction reports, the variable start-up phase of cleaning operations is separated from the monitoring. Monitoring takes place only after an arbitrarily established preset start-up time has lapsed following start-up.

Generally, the starting instruction is incorporated into the program controlling the entire cleaning system of which the tank interior cleaner is a part. The instruction is passed to the monitoring device only when the cleaning system has met various conditions which are sufficient for operation of the tank interior cleaner. A decisional disadvantage results from such a conditional relationship and occurs when the tank interior cleaner is supposed to be operated together with its monitoring device, outside and independent from the program-controlled cleaning system. This disadvantage, for example, exists with a tank interior cleaner mounted on a bracket in a tank, thereby making monitoring practically impossible. The starting instruction alone is not sufficient to obtain a proper monitoring of the tank interior cleaner since, for example, solvents may not be immediately available. Since the monitoring device cannot differentiate under any set of circumstances whether there are preparatory, inevitable pauses and/or delays or a breakdown of the cleanser supply, an alarm may be triggered.

With another embodiment of the invention, tank interior cleaners that are not permanently mounted and whose monitoring is not incorporated into a cleaning program, are monitored for the cleanser circulation power which is necessary for their intended cleaning effect. This is accomplished by starting monitoring by means of at least one conditional variable in the feed line of the tank interior cleaner which characterizes the necessary cleanser circulation power.

Further favorable process variants can provide for the start-up of monitoring upon the condition of pressure and/or cleanser flow velocity through a device which is arranged in the feed line to the tank interior cleaner and registers the pressure and/or flow velocity of the cleanser.

The advantages to be obtained are particularly realized as cleanser-powered tank interior cleaners not permanently installed can be activated independently from the program of a cleaning system and monitored for their necessary cleanser circulation power by known devices.

The operating mode of the monitoring device coupled with a device forming part of this invention for monitoring pressure and/or flow velocity of the cleanser is described below. The devices for registering pressure and/or flow velocity of the cleanser are installed in the feed line a short distance from the tank interior cleaner. As soon as at least one variable condition characterizing the necessary cleanser circulation power is reported, a starting instruction is passed to the monitoring device. Monitoring of the tank interior cleaner then begins after a preselected long start-up time has lapsed following the starting instruction. If the tank inside cleaner fails to rotate at the frequency of rotation necessary to obtain the intended cleaning effect after monitoring is commenced, an alarm is triggered. According to another variation of this invention, several tank interior cleaners can be monitoring successively. Such a variation reduces the equipment expense in monitoring the several tank interior cleaners.

According to another variation of the invention, two tank interior cleaners are monitored simultaneously. Monitoring can be economically provided through reduced equipment, standardized design volume for the circuit and the control.

The problem-solving invention, in terms of equipment, includes a monitoring device comprising a signal component, a current-voltage transducer and differentiating unit, the monitoring part including a timer for the monitoring time, a timer for the start-up time, potentiometers for the selective setting of the monitoring and start-up time, the starting device and the light-emitting diode connected with the signal emitter by means of lines for input current and modulated output current, and a modulator which interacts with the signal emitter by being preferably arranged on a noncontacting gear periphery of the device.

A preferable embodiment of the invention provides that the monitoring device consists of a monitoring part and, as a maximum, eight identical signal components. This makes it possible to successively monitor, as a maximum, eight tank interior cleaners with only one monitoring unit.

According to another preferable embodiment of the invention, the monitoring device consists of two signal units and two monitoring units, with each wired pairing of signal and monitoring device being independent from the other. This arrangement permits an economical use of the standardized design volume of the circuit carriers for the control.

An embodiment of the invention for the application of the inventive process is illustrated, for example, in the drawing and described hereafter in terms of design and mode of operation.

Figures 1, 2, 3, 4, 5:
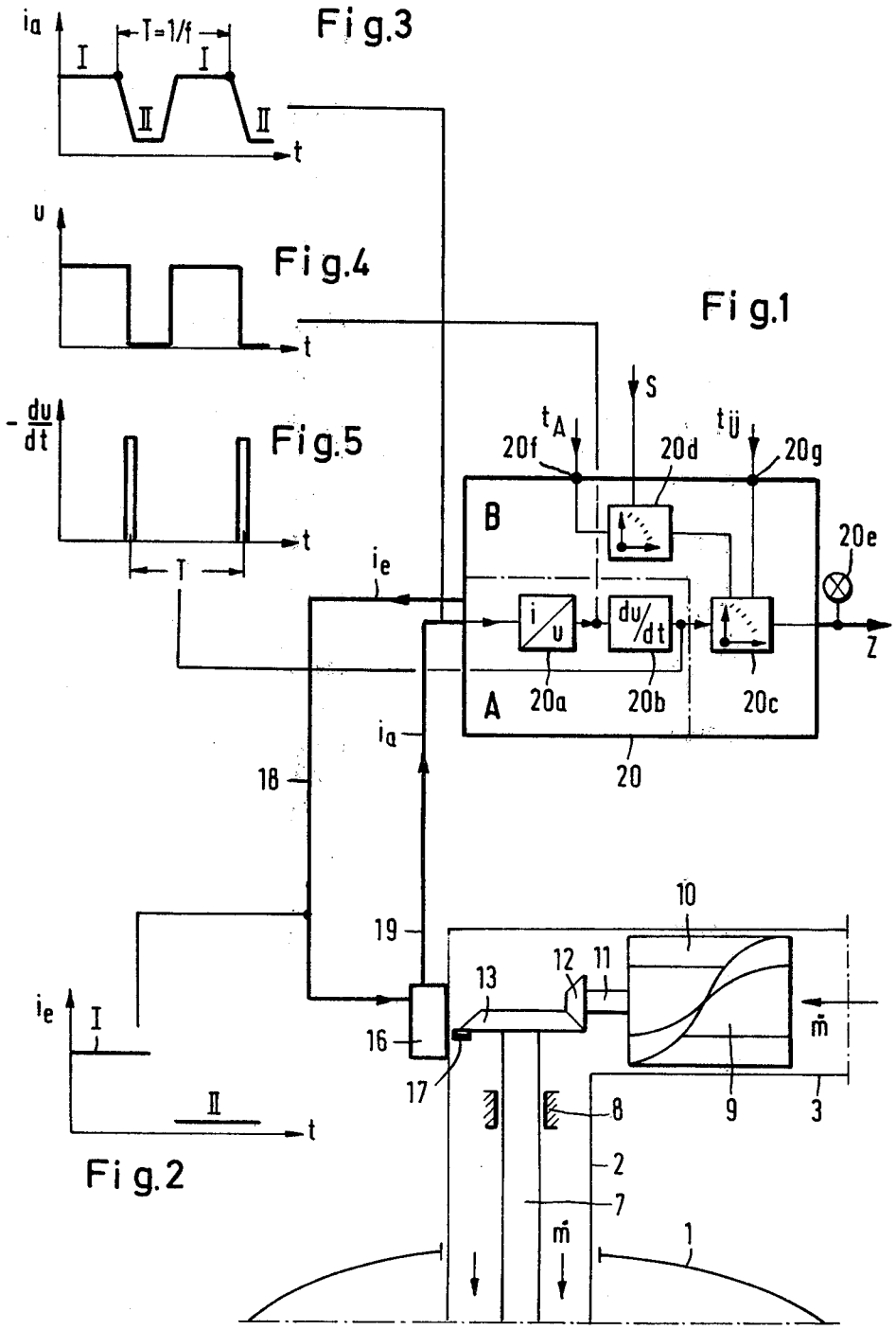
FIG. 1 shows a schematic illustration of the monitoring device.
FIG. 2 shows possible input current amplitudes of the signal emitters.
FIG. 3 shows a typically modulated output current shape.
FIG. 4 shows the voltage shape resulting from FIG. 3 after the current-voltage transducer.
FIG. 5 shows the shape of the reset pulses resulting from FIGS. 3 and 4 after the differentiating unit.

Illustrated partially in the lower part of FIG. 1 is the tank interior cleaner previously known from the German patent disclosure No. P 26 45 401. It comprises a tank 1, cleaning tube 2, feed line 3, shaft 7 driving a rotary element 4 (not shown), bearing 8, turbine wheel 9 with blades 10, drive shaft 11, and gears 12 and 13. The part of the tank interior cleaner shown is exposed to the cleanser flow m which drives the turbine wheel 9 by way of its blades 10 and thus, through gears 12 and 13, the shaft 7 and nozzle-equipped rotary element 4 which is not shown. The nozzle-equipped rotary element is driven at a frequency of rotation $f=1/T$ ($T$=time of revolution of the rotary element 4).

A signal emitter 16 is arranged on the outside of the cleaning tube 2 and located in the effective area of modulator 17 which is located on the periphery of gear 13. The signal emitter 16 is connected with the monitoring device 20 by way of lines 18 and 19 to provide input current $i_e$ and modulated output current $i_a$ respectively. The monitoring device 20 can be subdivided into two parts; the signal component A and the monitoring component B. Viewed in the sequence of signal processing, the monitoring device 20 comprises the voltage-current transducer 20*a*, the differentiating unit 20*b*, and the timer 20*c* for the monitoring time $t_U$. Acting on the timer 20*c* for the monitoring time $t_U$ is the timer 20*d* for the start-up time $t_A$. The timer for start-up time is actuated by way of a start device S not shown. A monitoring time $t_U$ and the start-up time $t_A$ can be selectively set by potentiometers 20*g* and 20*f* (indicated schematically) within a given range. The output of the monitoring device 20 is a binary digital malfunction signal Z which is also indicated optically by a light-emitting diode 20*e*.

The device of this invention operates as follows. The signal emitter 16 receives, depending upon the position of the modulator 17, an input amplitude of I or II (FIG. 2) as a result of the inductive influence of the modulator 17 which is moved by gear 13. The input current amplitude II is produced when the metallic modulator 17 has reached its shortest distance from the signal emitter 16. The input current $i_e$ reaches the amplitude I when the metallic modulator is not adjacent the signal emitter 16.

The output current shape from the signal emitter 16 (t) produced by the periodic approach of modulator 17 to the signal emitter 16 is illustrated in FIG. 3. The spacing of the periodically located points as shown in FIG. 3 represents the time of revolution T of the rotary element 4. This output current shape $i_a$ (t) is converted in the current-voltage transducer 20*a* to the rectangular voltage u (t) as shown in FIG. 4. Next, the negative-going excursion of the voltage u (t) is differentiated in the differentiating unit 20*b* as shown in FIG. 5. Voltage pulses du/dt are created at the spacing of time T corresponding to each revolution of the rotary element. They are the output magnitude of the signal part A of monitoring device 20 which consists of the current/voltage transducer 20*a* and the differentiating unit 20*b*. Each last voltage pulse serves as a reset pulse for the adjustable monitoring time $t_U$. If the timer 20*c* for the monitoring time $t_U$ is not reset by the last voltage pulse du/dt within the monitoring time $t_U$, a malfunction signal Z is given; and the light-emitting diode 20*e* is lighted simultaneously. Instead of diode 20*e*, it is possible to use another signal emitter, for example, an acoustic signal emitter. The monitoring time $t_U$ is selectively adjustable through the potentiometer 20*g* over a given range. It exceeds by a certain percentage the time set for rotation of the rotary element 4 ($t_U=K\times T$; $K>1$).

In order for the rotational frequency monitoring to begin only after the start-up phase of the cleaning operation, a timer 20*d* for the start-up time $t_A$ is provided in the monitoring part B. The start-up time is started via a starting device S (not shown). The start-up time is adjusted on the potentiometer 20*f* depending upon the start-up conditions of the cleaning system.

In a preferable embodiment of the device of this invention, the monitoring device 20 consists of a monitoring part B and, at a maximum, eight identical signal parts A which are connected with the monitoring part B. This makes it possible to economically monitor the maximum of eight tank interior cleaners successively with one and the same monitoring part B within the standardized design volume of the circuitry support for the control.

According to another embodiment of the invention, two signal parts A and monitoring parts B each can be economically accommodated within a given standardized design volume of circuitry supports for the control, with each wired pairing of signal part A and monitoring part B being independent from the other. This embodiment of the monitoring device permits simultaneous monitoring of two tank interior cleaners.

The components of the monitoring device 20 and the signal emitter 16 are electronic components whose design and operating mode are known in the art and familiar to one skilled in the art.

What is claimed is:

1. In a process for monitoring of cleanser-powered tank interior cleaners including a revolving rotary element forming part of a cleanser feed path to at least one discharge nozzle and indicating the completion of each full revolution of the rotary element, the improvement comprising positively driving the rotary element by driving the blades of a turbine with flowing solvent and by drive means interconnecting the turbine and the rotary element within the cleanser feed path and simultaneously monitoring the solvent quantity made available per unit of time and rate of revolution of the rotary element by sensing the rate of rotation in the cleanser feed path of the drive means between the turbine and the rotary element.

2. In a process for the monitoring of cleanser-powered tank interior cleaners, featuring a revolving rotary element within a cleanser feed path which forms part of the cleanser feed path to at least one discharge nozzle and indicating the completion of each full revolution of the rotary element, the improvement comprising first sensing the pressure or flow velocity of the cleansing solvent in the feed line to the tank interior cleaner which characterizes the necessary cleaning action, and after a preset start-up time, simultaneously monitoring the solvent quantity made available per unit of time and the rate of revolution of the rotary element by sensing the rate of rotation of the rotary element within the cleaner feed path.

3. The process of claims 1 or 2 further comprising establishing a monitoring time representing the time of revolution of the rotary element required for sufficient cleaning effect, monitoring the time of revolution of the rotary element for each full revolution in such a fashion that said time is represented by the spacing in time of two voltage pulses, with the last voltage pulse serving as a reset pulse for the monitoring time, the monitoring time exceeding by an adjustable percentage a set time of revolution for a rotary element, and, beginning the monitoring time anew in the event each rotary element revolution is completed within the monitoring time, and, in the event that the time of revolution of the rotary element exceeds the monitoring time, activating a malfunction signal.

4. The process according to claim 2, wherein the sensing is performed by a device in the cleanser feed path a short distance from the rotary element of the tank interior cleaner registering the pressure or cleanser flow velocity.

5. The process for the monitoring of cleanser-powered tank interior cleaners according to claim 3, wherein monitoring takes place after completion of a selectively presettable start-up time that is initiated and follows a starting instruction.

6. The process for the monitoring of cleanser-powered tank interior cleaners according to claim 2, wherein several tank interior cleaners are monitored successively.

7. The process for the monitoring of cleanser-powered tank interior cleaners according to claim 5, wherein two tank cleaners are monitored simultaneously.

* * * * *

UNITED STATES PATENT AND TRADEMARK OFFICE

CERTIFICATE OF CORRECTION

PATENT NO. : 4,343,656

DATED : August 10, 1982

INVENTOR(S) : Otto A. P. Tuchenhagen

It is certified that error appears in the above-identified patent and that said Letters Patent is hereby corrected as shown below:

Column 1, line 52, delete "cleaner" and insert --cleanser-- therefor.

Column 2, line 13, delete "cleaner" and insert --cleanser-- therefor.

Signed and Sealed this

*Twenty-third* Day of *November 1982*

[SEAL]

*Attest:*

GERALD J. MOSSINGHOFF

*Attesting Officer*

*Commissioner of Patents and Trademarks*